US009995099B2

(12) United States Patent
Halfmann

(10) Patent No.: US 9,995,099 B2
(45) **Date of Patent: *Jun. 12, 2018**

(54) HIGH COLLAPSE PRESSURE CHAMBER AND METHOD FOR DOWNHOLE TOOL ACTUATION

(71) Applicant: BAKER HUGHES INCORPORATED, Houston, TX (US)

(72) Inventor: Eric Halfmann, Magnolia, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 701 days.

This patent is subject to a terminal disclaimer.

(21) Appl. No.: 14/535,951

(22) Filed: Nov. 7, 2014

(65) Prior Publication Data

US 2016/0130896 A1 May 12, 2016

(51) Int. Cl.

| | |
|---|---|
| ***E21B 23/04*** | (2006.01) |
| ***E21B 23/06*** | (2006.01) |
| ***E21B 23/01*** | (2006.01) |
| ***E21B 17/07*** | (2006.01) |

(52) U.S. Cl.

CPC ..... *E21B 23/04* (2013.01); *E21B 17/07* (2013.01); *E21B 23/01* (2013.01); *E21B 23/06* (2013.01)

(58) Field of Classification Search

CPC ..... E21B 23/00; E21B 23/04; E21B 23/06

See application file for complete search history.

(56) References Cited

U.S. PATENT DOCUMENTS

| | | | | |
|---|---|---|---|---|
| 7,891,434 | B2 | 2/2011 | Gaudette et al. | |
| 8,210,267 | B2 | 7/2012 | Avant | |
| 8,813,857 | B2 * | 8/2014 | Mills | E21B 23/04 166/122 |
| 2010/0243269 | A1 * | 9/2010 | Solhaug | E21B 23/06 166/374 |
| 2012/0090854 | A1 * | 4/2012 | Ringgenberg | E21B 17/00 166/382 |
| 2014/0150417 | A1 * | 6/2014 | Kalb | E21B 23/04 60/329 |

* cited by examiner

*Primary Examiner* — Robert E Fuller

(74) *Attorney, Agent, or Firm* — Mossman, Kumar & Tyler, PC

(57) ABSTRACT

A setting tool for performing a wellbore operation includes a mandrel, a cylinder slidably engaged with the mandrel, and a variable volume first chamber formed between the mandrel and the cylinder and a containment member having a second chamber adjacent to the first chamber. The setting tool also includes a support fluid disposed in the first chamber, a slidable support axially and circumferentially distributed inside the first chamber, and a valve disposed between the first chamber and the second chamber. The valve is configured to flow the support fluid from the first chamber to the second chamber. The support fluid and the slidable support, support the cylinder against a downhole pressure. The setting tool is conveyed into the wellbore and connected to a consumer. The setting tool is actuated to set the consumer.

16 Claims, 3 Drawing Sheets

HIGH COLLAPSE PRESSURE CHAMBER AND METHOD FOR DOWNHOLE TOOL ACTUATION

CROSS-REFERENCE TO RELATED APPLICATIONS

None

BACKGROUND OF THE DISCLOSURE

1. Field of the Disclosure

This disclosure relates generally to oilfield downhole tools and more particularly to methods and devices for hydrostatically setting a downhole tool.

2. Description of the Related Art

As the oil and gas industry continues to explore and produce from wells that are deeper and have higher hydrostatic pressures, designing downhole tools that can operate in high temperatures and high hydrostatics becomes a challenge. Hydrostatically setting a tool in a high hydrostatic environment can be difficult due to the strength limitations of tools. In some aspects, the present disclosure is directed to methods and devices for hydrostatically setting a downhole tool even in high hydrostatic pressures.

SUMMARY OF THE DISCLOSURE

In one aspect, the present disclosure provides a setting tool for performing a wellbore operation. The setting tool may include a mandrel, a cylinder slidably engaged with the mandrel, a variable volume first chamber formed between the mandrel and the cylinder, a containment member having a second chamber adjacent to the first chamber, and a support fluid disposed in the first chamber. The setting tool may also have a valve disposed between the first chamber and the second chamber, wherein the valve flows the support fluid from the first chamber to the second chamber, and a slidable support axially and circumferentially distributed inside the first chamber, wherein the support fluid and the slidable support support the cylinder against a downhole pressure.

In another aspect, the present disclosure provides a method for performing a wellbore operation. The method may include connecting a consumer to a setting tool, conveying the consumer and the setting tool into a wellbore, and actuating the setting tool to set the consumer. The setting tool may include a mandrel, a cylinder slidably engaged with the mandrel, a variable volume first chamber formed between the mandrel and the cylinder, a containment member having a second chamber adjacent to the first chamber, a support fluid disposed in the first chamber. The setting tool may also have a valve disposed between the first chamber and the second chamber, wherein the valve flows the support fluid from the first chamber to the second chamber, and a slidable support axially and circumferentially distributed inside the first chamber, wherein the support fluid and the slidable support support the cylinder against a downhole pressure.

Illustrative examples of some features of the disclosure thus have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION OF THE DISCLOSURE

The present disclosure relates to devices and methods for setting a downhole tool in subterranean hydrostatics. As used herein, 'hydrostatics' refers to the hydrostatic pressure of the fluid present in a wellbore. Illustrative devices provide a liquid filled structural support that allows the use of hydrostatic pressure to set the downhole tool without crushing the device.

Figure 1:
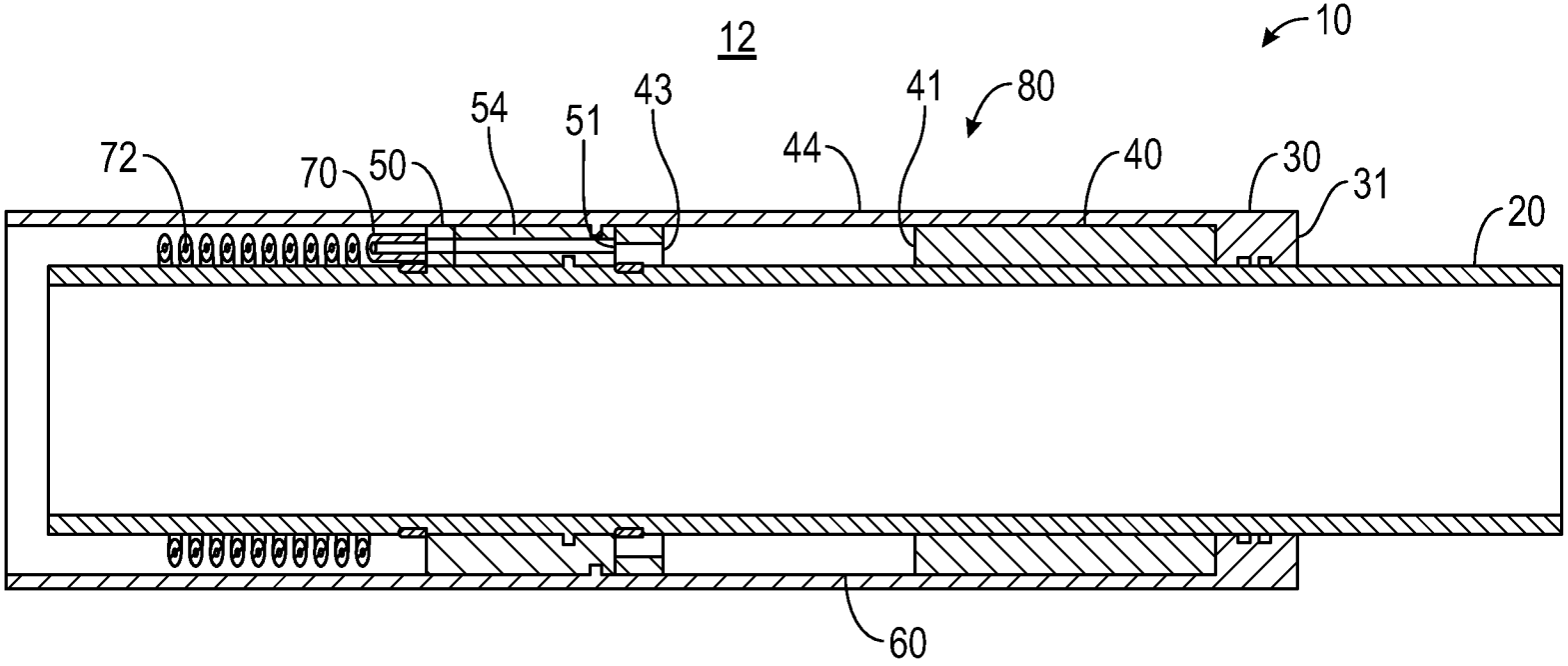
FIG. 1 shows an exemplary setting tool in a run-in position according to the present disclosure.

FIG. 1 shows one non-limiting embodiment of a setting tool 10 according to the present disclosure. The setting tool 10 includes a cylinder 30 that is disposed around a mandrel 20. The setting tool 10 also includes a valve 50 that controls fluid flow between a variable volume first chamber 60 and a separate fixed volume second chamber 70. The pressure differential between the first chamber 60 and the surrounding hydrostatics generates the force for displacing the cylinder 30. To address high hydrostatics, the first chamber 60 can be filled with a support fluid at a charge pressure that counteracts the annulus pressure acting on the outer surfaces of the cylinder 30. These hydrostatics can also be counteracted by a slidable support 80 disposed in the first chamber 60. By counteracting the surrounding hydrostatics, the setting tool 10 may be used in relatively high hydrostatics with minimal risk of damage due to crushing.

Figure 3:
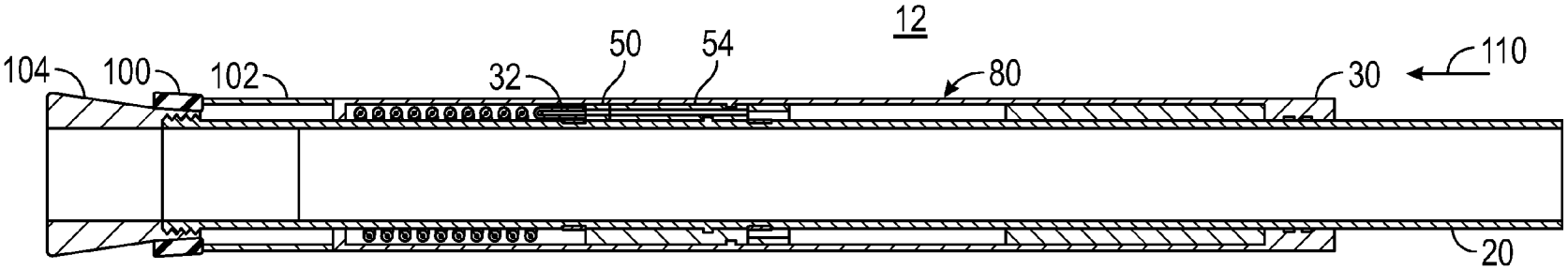
FIG. 3 shows an exemplary setting tool with an exemplary consumer in a run-in position.

The first chamber 60 may be formed as an annular space between the mandrel 20 and the cylinder 30. The pressure in the first chamber 60 is selected to create the pressure difference across the piston wall 31 of the cylinder 30 to move the cylinder 30 and thereby set a consumer 100 (FIG. 3). Prior to the setting operation, the support fluid fills the first chamber 60 and keeps an external pressure differential, the collapse pressure, below values that would crush or otherwise damage the setting tool 10. In some embodiments, the support fluid may be an incompressible fluid such as water or oil (e.g., a hydraulic liquid). In addition, the support fluid may selectively prevent the slidable support 80 from elastic collapse.

The slidable support 80 cooperates with the support fluid to support the first chamber 60. In embodiments, the slidable support 80 may be a structure that provides a frame that can accept the loading caused by hydrostatics. For example, the slidable support 80 can be collets that include a male 40 and female 44 interlocking bodies. The male and female interlocking bodies 40, 44 may be reciprocally engaging collet fingers. The interlocking bodies 40, 44 can be spaced apart such that when they move towards each other, a bottom end 41 of the male body 40 meets a lower end 43 of the female body 44. Therefore, the slidable support 80 has two states: an elongated state when the first chamber 60 is fully extended and a compacted state when the cylinder 30 strokes. The slidable support 80 accommodates the reduced volume of the first chamber 60 by transitioning to the compacted state. During this transition, the male body 40 engages with the female body 44, and/or teeth of the male body 40 fills the gap between teeth of the female body 44.

The second chamber 70 provides a reservoir to receive the support fluid flowing out of the first chamber 60 via the valve 50. The second chamber 70 may be at a pressure, such as atmospheric pressure or a lower or higher pressure, or vacuum. The second chamber 70 may be filled with a fluid such as air, nitrogen or other fluid. The second chamber 70 can be contained in a containment member 72 such as tubes, pipes, hoses, canisters, tanks, etc. The containment member 72 may be sealed and axially constrained with respect to the mandrel 20.

The valve 50 controls fluid communication between the first chamber 60 and the second chamber 70. One port of the valve 50 is connected to the first chamber 60 and the other port is connected to the second chamber 70. An electronic member 54 may be located next to the valve 50 between the mandrel 20 and the cylinder 30. The electronic member 54 can be used to open, close, or meter the valve 50. When opened, the valve 50 allows the support fluid in the first chamber 60 to flow into the second chamber 70. During setting, the valve 50 may selectively communicate the support fluid from the first chamber 60 to the second chamber 70. As used herein, the term selective means that a tool or device is configured to behave in a specific manner when subjected to a predetermined condition.

Illustrative methods for using the setting tool 10 to actuate the consumer 100 will be discussed with reference to FIGS. 2A-B, and 3.

Figure 2A:
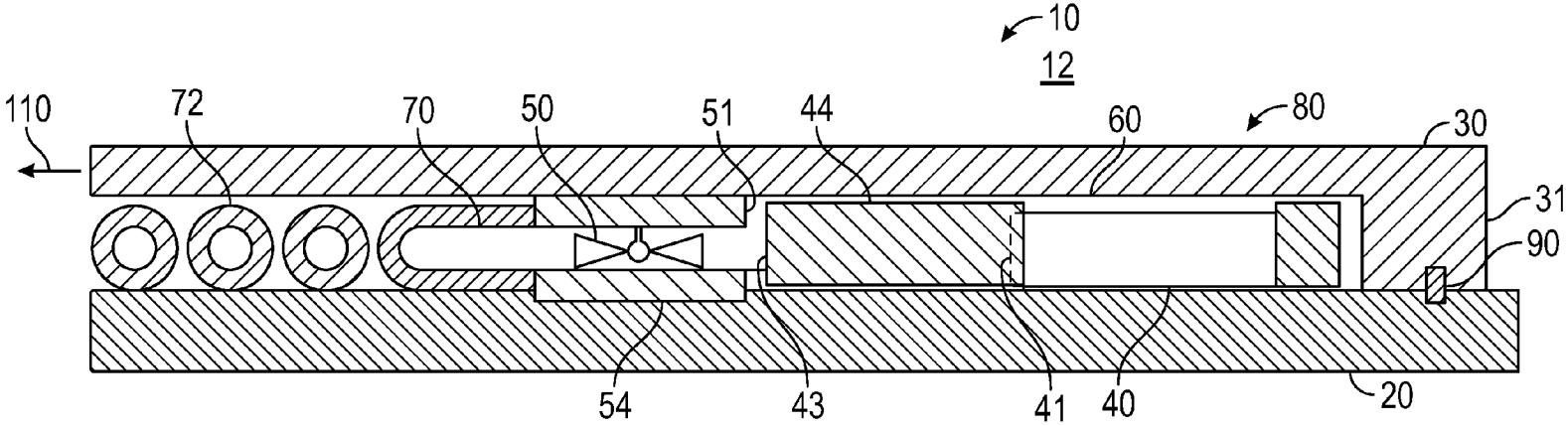
FIG. 2A shows an exemplary setting tool in the run-in position.
Figure 2B:
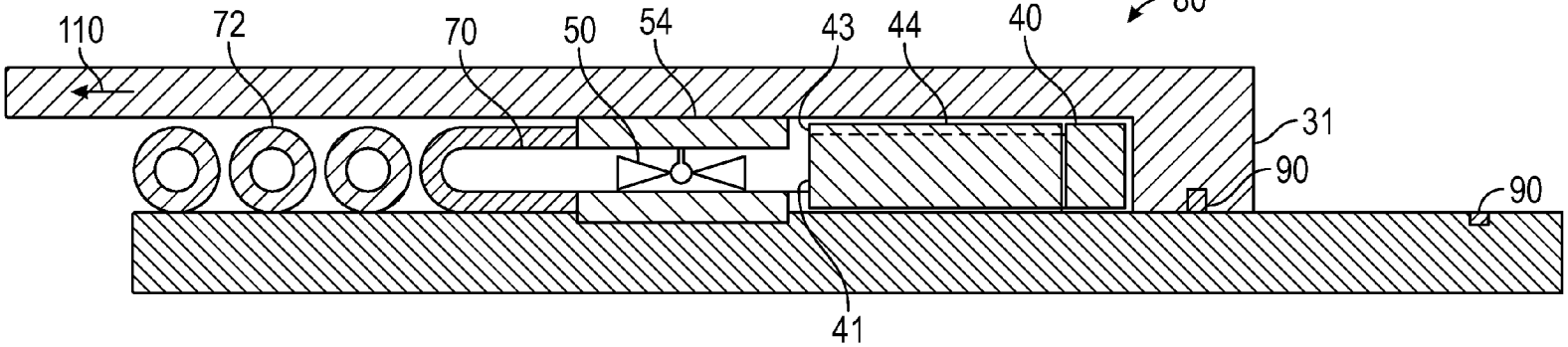
FIG. 2B shows an exemplary setting tool in a set position.

FIG. 2A-B show the setting tool 10 in run-in position and set position, respectively. Referring to FIG. 2A, when the tool 10 is run downhole, the slidable support 80 is in the elongated state. As used herein, the pressure difference between the annulus pressure and the pressure of the first chamber 60 will be referred to as the stroke pressure. The stroke pressure pushes the cylinder 30 in the setting direction 110. However, the cylinder 30 stays fixed with respect to the mandrel 20 due to a locking mechanism 90 and the support fluid in the first chamber 60. In one embodiment, the locking mechanism 90 can connect the cylinder 30 to the mandrel 20. The locking mechanism 90 may be a shear pin, a shear screw, a shear ring, a key, or dogs. Therefore, during run-in, the cylinder 30 is stationary with respect to the mandrel 20.

The differential pressure across the cylinder 30, between the annulus 12 and the first chamber 60, also acts as the collapse pressure. The collapse pressure tries to crush the cylinder 30 elastically or plastically. Alternatively, the mandrel 20 may also be susceptible to crush due to pressure differential between a flow bore inside the mandrel 20 and the first chamber 60. In either case, the support fluid and the slidable support 80 counteract the pressure acting on the cylinder 30 and thereby mitigating this undesirable pressure condition.

Prior to the setting operation, as the hydrostatic pressure increases, the cylinder 30 will try to compress the support fluid. A relatively incompressible support fluid will prevent the cylinder 30 from stroking and the pressure of the support fluid will effectively equalize with the hydrostatic pressure. This will significantly reduce the external pressure differential trying to crush the cylinder 30 to a manageable level.

After the locking mechanism 90 is unlocked, the cylinder 30 is still stationary with respect to the mandrel 20 because the valve 50 is closed and prevents the support fluid from flowing out of the first chamber 60. Therefore, the pressure is balanced between the first chamber 60 and the annulus 12. This pressure balance eliminates the external pressure differential acting on the cylinder 30, preventing the cylinder 30 from stroking axially or being crushed.

Referring to FIG. 2B, after the locking mechanism 90 is released, an actuation signal triggers the onboard electronics 54, and the valve 50 opens. The actuation signal may be sent from the surface or may be generated downhole in response to a determined status of the locking mechanism 90, pressure, time period, etc. When the valve 50 opens, the hydrostatic pressure displaces the support fluid from the first chamber 60 and causes the cylinder 30 to move in the direction 110. The pressurized support fluid flows into the second chamber 70 and the stroke pressure pushes the cylinder 30 in the setting direction 110. As the support fluid flows through the valve 50, the pressure of the first chamber 60 decreases and the pressure in the second chamber 70 increases. During this motion, the support fluid can lubricate the contact surfaces and reduce the amount of friction between the cylinder 30, the slidable support 80 and the mandrel 20.

From the above, it should be appreciated that the support fluid may be used to support the cylinder 30 before and during the stroke against high hydrostatic pressures in the annulus 12. Further, the fluid flow from the first chamber 60 may be metered. Metering the flow can maintain a sufficient amount of support fluid within the first chamber 60 to continue counteracting the hydrostatic force as the cylinder 30 moves.

After the support fluid leaves the first chamber 60, the slidable support 80 in the first chamber 60 takes over to provide support to the structure against the collapse pressure at full stroke. Of course, the slidable support 80 may also support the cylinder 30 during the stroke against high hydrostatic pressures in the annulus 12. The cylinder 30 may be exposed to a maximum collapse pressure at full stroke. A safety factor may be employed to compensate for material properties or downhole conditions.

The cylinder 30 can stroke all the way until the slidable support 80 is completely compact or may stroke less than a full length, whichever is necessary to actuate the consumer 100. In either case, the setting tool 10 can be designed to provide, at a minimum, a required setting pressure to set the consumer 100.

In an embodiment, the second chamber 70 may provide enough vacuum to take the support fluid. Optionally, sets of the chambers 60, 70 may be stacked in series to reach the setting force. Accordingly, multiple first chamber 60 and second chamber 70 combinations may push the slidable support 80. In that case, each first chamber 60 will have a slidable support 80.

FIG. 3 shows the cylinder 30 exerting a setting force on the consumer 100. The consumer 100 may be a packing element, a liner hanger, a slip assembly, a cone, and/or an expandable tubular. The consumer 100 and the setting tool 10 are assembled at the surface and deployed downhole. In FIG. 3, the setting tool is in the run-in position and the locking mechanism 90 is not released. The setting tool 10 can be actuated by releasing the locking mechanism 90 and opening the valve 50. This allows the hydrostatic pressure to stroke the cylinder 30. As the cylinder 30 moves, the consumer 100 extends radially out leveraged by a cone 104 or similar structure.

It should be understood that the teachings of the present disclosure are susceptible to numerous variants. Certain non-limiting variations are described below.

In an embodiment, an intermediate member 102 may connect the cylinder 30 and the consumer 100. Optionally, the consumer 100 and the setting tool 10 may be run separately into the wellbore and connected downhole. Alternatively, the cylinder 30 may stroke in uphole or downhole direction depending on the axial positioning of the consumer 100 with respect to the setting tool 10 and the need to push or pull the consumer 100.

Also, in some embodiments, the mandrel 20, instead of the cylinder 30 may stroke and push the consumer 100. The cylinder 30 may also rotate while stroking axially. Accordingly, the teeth of the interlocking bodies 40 and 44 may helically engage. Alternatively, the cylinder 30 or mandrel 20 may include additional cylinders, mandrels or parts. In other embodiments, multiple valves 50 may be disposed in the setting tool 10 for contingency or increased stroke force. Optionally, the valve 50 may be located in the mandrel 20 or some other member between the chambers 60 and 70.

The valve 50 is a fluid restriction device engineered to control flow based on technical requirements. The valve 50 may be a check valve, a diaphragm, a rupture disc, an electrically actuated valve, a magnetically activated valve, a poppet valve, a ball valve, a dissolvable element and/or other fluid restriction device. The valve 50 may be an adjustable flow control device that can be set to permit fluid communication between the chambers 60 and 70. In some embodiments, several different types of valves 50 may be employed in one setting tool 10. The electronic member 54 or mechanical shifting methods may both operate the valve 50 for redundancy.

The electronic member 54 may be connected to the valve 50 and monitor the pressure or the pressure changes of the annulus 12. Alternatively, the electronic member 54 may activate the valve 50 based on a clock or passage of time or after a conditional event. Or, the electronic member 54 may be omitted, and the valve 50 may be operated by mechanical means only.

The valve 50 may actively be controlled from the surface or may open in response to a specific detected condition. The valve 50 may allow the pressurized support fluid flow into the second chamber 70 in a selective and controlled manner before or after the locking mechanism 90 is released to prevent an impulse of the slidable support 80. In some embodiments, the impulse may be desired. Then, the valve 50 can be designed accordingly.

In another mode of operation, the valve 50 may be opened before the locking mechanism 90 is released. In that case, the support fluid fills the second chamber 70 before the cylinder 30 strokes. However, the valve 50 can control the amount and rate of support fluid flow. The support fluid flow may be below or above a predetermined flow rate, or in a range. Once the locking mechanism 90 is unlocked, the cylinder 30 strokes.

A fluid property of the support fluid may be viscosity, density, surface tension, phase, etc. The fluid property of the support fluid may be selected to allow a friction between the cylinder 30 and the mandrel 20 to be below or above a predetermined frictional force, or in a range. The support fluid in the first chamber 60 may be water and/or oil. In another variant, a compressible fluid such as nitrogen gas and/or some other gas may be used. In that case, the setting tool 10 may stroke without the valve 50 being opened. Also, the cylinder 30 may shift and abut a wall 51 of the first chamber 60. In that case, the hydrostatic pressure applied to the cylinder 30 is exerted on the consumer 100.

Figure 4:
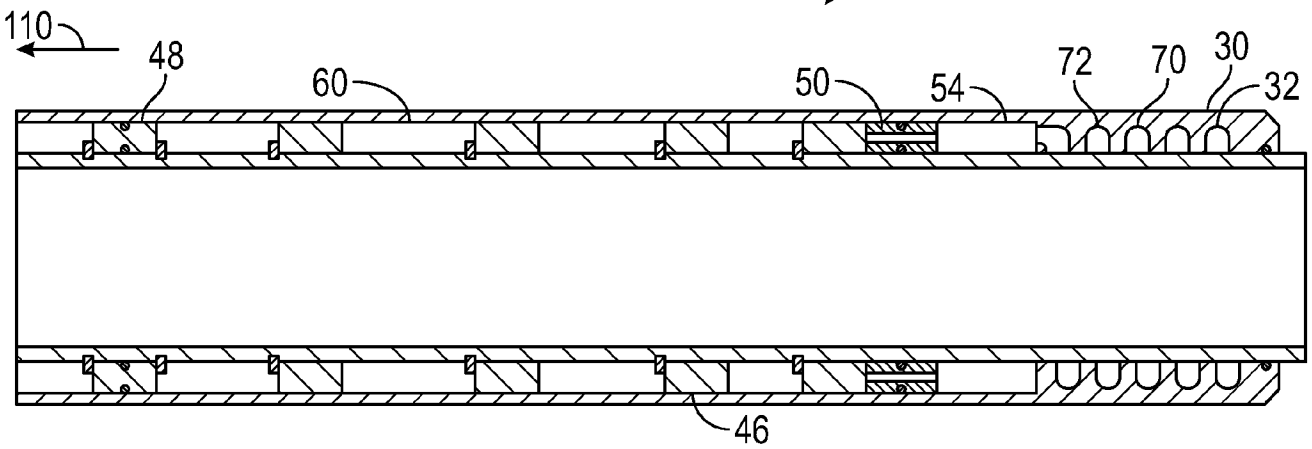
FIG. 4 shows an exemplary setting tool with a containment member attached to a cylinder in a run-in position.

In FIG. 1, the second chamber 70 is located between the consumer 100 and the first chamber 60. In another embodiment, as depicted in FIG. 4, the first chamber 60 may be located between the consumer 100 and the second chamber 70. Or, the second chamber 70 may be a variable volume chamber and located internally or externally to the cylinder 30.

Also, alternatively, as depicted in FIG. 4, the slidable support 80 may be rings 46, springs, ribs, cylindrical elements, bearings, and/or other axially elongated elements. As the cylinder 30 strokes toward the direction 110, shear screws or other temporary engaging mechanisms may be disengaged and allow the rings 46 to slide consecutively until the cylinder 30 shoulders on a stop 48.

In another embodiment, as depicted in FIG. 4, the containment member 72 may be channels milled into the cylinder 30. Other containment members 72 may be, but not limiting, a coiled tube, an annular space, and a helical thread profile.

In above embodiments, the hydrostatic pressure or the annulus pressure may be substituted for convenience. The hydrostatic pressure may include a pump pressure.

The foregoing description is directed to particular embodiments of the present disclosure for the purpose of illustration and explanation. It will be apparent, however, to one skilled in the art that many modifications and changes to the embodiment set forth above or embodiments of different forms are possible without departing from the scope of the disclosure. It is intended that the following claims be interpreted to embrace all such modifications and changes.

I claim:

1. An apparatus for performing a wellbore operation in a wellbore having a fluid, comprising:

a mandrel;

a cylinder slidably engaged with the mandrel and having an outer surface exposed to a hydrostatic pressure of the fluid in an annulus surrounding the cylinder, the cylinder configured to slide between a first position and a second position;

a variable volume first chamber formed between the mandrel and the cylinder;

a containment member having a second chamber adjacent to the first chamber;

a support fluid disposed in the first chamber;

a valve disposed between the first chamber and the second chamber, wherein the valve flows the support fluid from the first chamber to the second chamber; and a slidable support axially and circumferentially distributed inside the first chamber, wherein the support fluid and the slidable support support the cylinder against a downhole pressure, wherein the cylinder is configured to slide from the first position to the second position in response to a hydrostatic pressure applied to the cylinder by the fluid in the wellbore.

2. The apparatus of claim 1, wherein the slidable support prevents the first chamber from collapse due to the downhole pressure after the valve flows the support fluid from the first chamber.

3. The apparatus of claim 1, wherein the valve is configured to maintain a flow of the support fluid from the first chamber below a predetermined flow rate.

4. The apparatus of claim 1, wherein the containment member has a fixed volume.

5. The apparatus of claim 1, wherein the containment member is coupled to the cylinder.

6. The apparatus of claim 1, wherein the containment member comprises at least one of: (i) a coiled tube, (ii) a channel, (iv) an annular space, and (v) a milled helical thread profile.

7. The apparatus of claim 1, wherein the slidable support includes at least one of: (i) collets, (ii) a ring, (iii) a spring, (iv) ribs, (v) a cylindrical element, (vi) bearings, and (vii) an axially elongated element.

8. The apparatus of claim 1, wherein the support fluid is a liquid and, further comprising a gas disposed inside the second chamber.

9. The apparatus of claim 1, wherein the valve is at least one of: (i) a pressure relief valve, (ii) a check valve, (iii) a diaphragm, (iv) a rupture disc, (v) an electrically actuated valve, (vi) a magnetically activated valve, (vii) poppet valve, (viii) a ball valve, (ix) dissolvable element, and (x) a fluid restriction device.

10. The apparatus of claim 1, further comprising a multiple of first chambers and second chambers positioned adjacent to the cylinder.

11. The apparatus of claim 1, further comprising a consumer attached to the sleeve, wherein the consumer is at least one of: (i) a packer assembly, (ii) a liner hanger, (iii) a slip assembly, (iv) a cone, and (v) an expandable.

12. A method for performing a wellbore operation, comprising:

connecting a consumer to a setting tool that includes:

a mandrel;

a cylinder slidably engaged with the mandrel and having an outer surface exposed to a hydrostatic pressure of a fluid in an annulus surrounding the cylinder;

a variable volume first chamber formed between the mandrel and the cylinder;

a containment member having a second chamber adjacent to the first chamber;

a support fluid disposed in the first chamber;

a valve disposed between the first chamber and the second chamber, wherein the valve flows the support fluid from the first chamber to the second chamber; and a slidable support axially and circumferentially distributed inside the first chamber, wherein the support fluid and the slidable support support the cylinder against a downhole pressure;

conveying the consumer and the setting tool into the wellbore;

and actuating the setting tool to set the consumer by moving the cylinder using the hydrostatic pressure of the fluid in the wellbore and by reducing the pressure of the support fluid.

13. The method of claim 12, further comprising preventing a collapse of the first chamber when the setting tool is run to a subterranean location by using the support fluid to balance the hydrostatic pressure applied by the fluid in the wellbore.

14. The method of claim 12, further comprising counteracting a force on the cylinder created by the hydrostatic pressure of the fluid in the wellbore by using the slidable support after moving the cylinder.

15. The method of claim 12, wherein actuating the setting tool comprises:

unlocking a locking mechanism connecting the cylinder to the mandrel to allow the cylinder to shift in response to a pressure difference between the hydrostatic pressure in the annulus and the first chamber.

16. The method of claim 12, further comprising using the support fluid to reduce friction between the cylinder and the mandrel.

* * * * *